US008684223B1

(12) United States Patent
Kalamaras

(10) Patent No.: US 8,684,223 B1
(45) Date of Patent: Apr. 1, 2014

(54) THERMAL DRINKING GLASS

(76) Inventor: Michael P. Kalamaras, Cary, IL (US)

( * ) Notice: Subject to any disclaimer, the term of this patent is extended or adjusted under 35 U.S.C. 154(b) by 142 days.

(21) Appl. No.: 13/105,299

(22) Filed: May 11, 2011

(51) Int. Cl.
*A47J 39/00* (2006.01)
*B65D 1/34* (2006.01)
*A47J 41/02* (2006.01)

(52) U.S. Cl.
USPC ..... 220/592.17; 220/573.4; 215/12.1

(58) Field of Classification Search
USPC ..... 220/592.17, 573.4, 574.3, 62.12, 62.14, 220/62.15, 662, 62.18, 62.22; 215/12.1, 215/13.1, 382; D7/523, 541, 560, 562, 566, D7/527, 531; 373/84
See application file for complete search history.

(56) References Cited

U.S. PATENT DOCUMENTS

D37,609 S * 10/1905 Fletcher ..... D6/434
2,577,030 A * 12/1951 Neumann ..... 250/487.1
D177,559 S * 5/1956 Emmert ..... D7/531
3,810,557 A * 5/1974 Cline ..... 215/12.1
D408,685 S * 4/1999 Lage et al. ..... D7/523
6,050,443 A * 4/2000 Tung ..... 220/592.17
D428,307 S * 7/2000 Yeandel ..... D7/531
6,961,179 B2 * 11/2005 Chen et al. ..... 359/485.04
D557,561 S * 12/2007 Flowers et al. ..... D7/531
2005/0045643 A1 * 3/2005 Ghanem ..... 220/592.17
2005/0173365 A1 * 8/2005 McKnight ..... 215/12.1
2005/0194340 A1 * 9/2005 Huang ..... 215/6
2005/0207141 A1 * 9/2005 Boesch et al. ..... 362/101
2010/0059522 A1 * 3/2010 Mayo ..... 220/506

* cited by examiner

*Primary Examiner* — Bryon Gehman
*Assistant Examiner* — Shawn M Braden
(74) *Attorney, Agent, or Firm* — James Creighton Wray

(57) ABSTRACT

A drinking glass has flutes inward from inside walls of an inner sleeve. Outer walls are curved. The flutes and curved outer walls form lenticular surfaces that distort images. The flutes provide precise alignment for multicolor printing on the outer wall of the inner sleeve. An outer sleeve is sealed to a top of the inner sleeve. A space between the sleeve is filled with fluid, sheets and objects.

21 Claims, 2 Drawing Sheets

FIG. 2
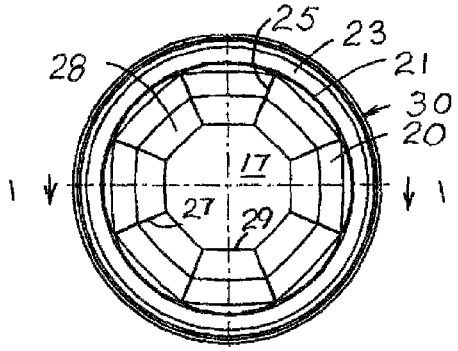
FIG. 4
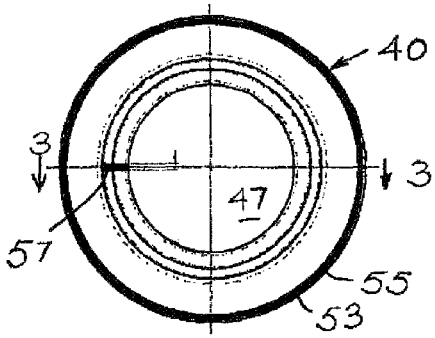
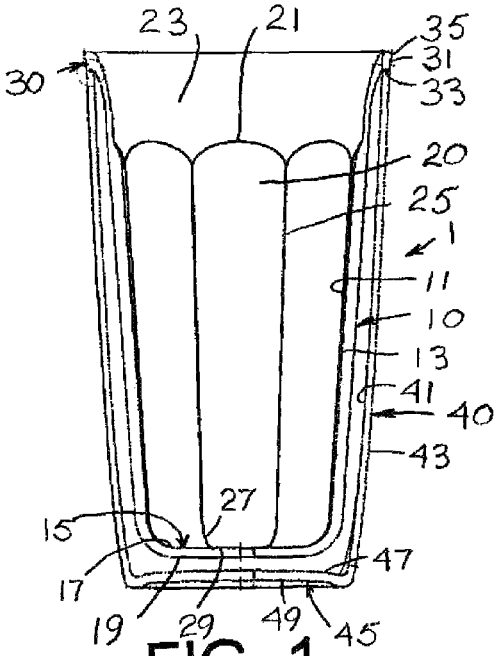
FIG. 1
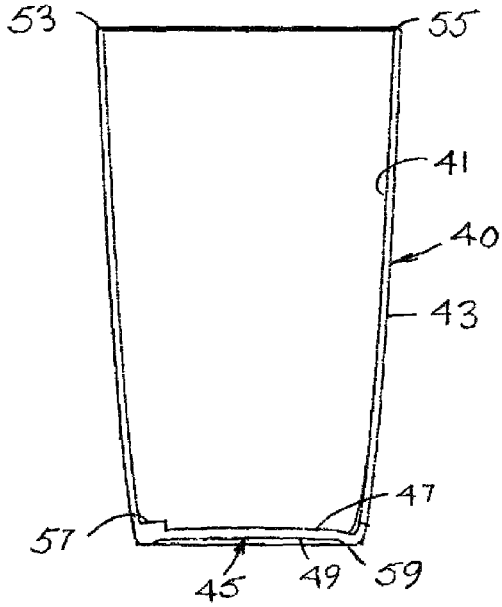
FIG. 3

30
25
21
23
20
17
28
27
29

30
71
70
73
30
20
25
11
10
13
19
15
29
27
17

30
23
21
20
11
10
13
25
27
29

35
30
31
33
61
63
10
13
15

THERMAL DRINKING GLASS

SUMMARY OF THE INVENTION

The new thermal drinking glass has a thermal wall with a unique construction.

Flutes on an inner surface of an inner sleeve are shown in a pattern offering optic viewing through a lenticular surface.

The flute pattern may vary in size and shape.

The flute is used for multiple thermal container applications of different sizes and shapes but not limited to and including tumblers, mugs, bowls, pitchers and ice buckets.

The flute pattern is embedded on the inner wall of the inner thermal sleeve for mechanical purposes to act as a locator for inner sleeve exterior wall printing. The inner sleeve exterior wall is smooth for printing graphics on an overall surface area. The outer sleeve is clear and smooth. The inner sleeve flutes provide lenses that show through the outer wall of the outer sleeve.

The outer sleeve is affixed to the inner sleeve at the upper lip edges by sonic welding, gluing, solvent bonding or any other standard method of adhesion that is done mechanically or chemically. In other methods, the outer sleeve is connected to the inner sleeve by means of a mechanical method such as a screw on or snap-on type locking system or both. The inner sleeve plastic is molded in a clear or transparent color, offering additional optical effects. The outer sleeve plastic is molded in a clear or transparent color, offering additional optic effects.

The inner sleeve accepts a lid, and the outer sleeve accepts a lid.

Before the outer and inner plastic sleeves are joined, an embroidered emblem or multiple emblems are placed on exterior surface of the inner wall of the outer sleeve or outer wall of the inner screen. Alternatively, fabric sheet stocks with or without printed graphics are placed and sealed between the outer sleeve and the inner sleeve outer wall.

Paper sheet stocks with printed graphics are placed and sealed between the outer sleeve and the inner sleeve outer wall. Plastic sheet stocks with printed graphics are placed and sealed between the outer sleeve and the inner sleeve outer wall. Mirrored plastic sheet stocks with graphics printed in transparent or solid colored inks are placed and sealed between the outer sleeve and the outer wall of the inner sleeve wall. Mirrored plastic sheet stock printed in full coverage in transparent or solid colored inks, are placed and sealed between the outer sleeve and inner sleeve.

The sealed cavity is filled with a gas which is air; another gas or a combination of gases. In other embodiments, liquid is injected i the sealed cavity created in between the inner sleeve outer wall and outer sleeve inner wall.

Liquid injected in the sealed cavity is accompanied by decorative graphic plastic sheet stock placed between the inner sleeve and outer inner sleeve. Alternatively, liquid injected in the sealed cavity is accompanied by floating decorative die cut or molded plastic parts of varying size, shape and weight. All is sealed in between the inner sleeve wall and the outer sleeve wall.

Solid material such as crushed rock or some other unique material is formed and sealed between the inner sleeve wall and the outer sleeve wall. A printed plastic or paper die cut shape is placed or adhered to the inner sleeve wall and sealed between the inner sleeve wall and the outer sleeve wall. A printed sheet stock showing a lenticular design graphic picture is placed or adhered to the inner wall and sealed between the inner sleeve wall and outer sleeve wall.

A combination or one of decorative pieces such as an emblem, full sheet paper or plastic or fabric or a die-cut paper, plastic, lenticular design or fabric material is placed on or adhered to the inner sleeve outer side wall accompanied by a liquid or a solid material such as sand, crushed rock, or glitter sealed between the inner sleeve wall and the outer sleeve wall.

The new thermal a drinking glass has an inside container and an outside container. The outside container surrounds and is spaced from the inside container. The outside container has an upper rim contacting and sealed to an upper lip of the inside container. Fluid is sealed in the space between the inside container and the outside container. The inside container has an inside wall and an outer wall. The outer container has an inner wall and an outside wall. The inside wall of the inside container has a series of generally vertically extending flat flutes adapted for precisely locating the inside container for accurately and precisely placing multicolor images on the outer wall of the inner container.

The inner container has inside and outer bottom surfaces. The outer container has inner and outside base surfaces. The outer bottom surface of the inner container is spaced from the inner base surface of the outer container.

The fluid sealed in the space between the outer and inner containers is a gas. In one form, the fluid sealed in the space between the outer and inner containers is a liquid. In another form, the fluid sealed in the space between the outer and inner containers is a liquid and a gas.

The upper rim of the outer container is flat and annular. The upper lip of the inner container has a cylinder radially outset from the outer wall of the inner container. A flat lower surface of the cylinder is sealed with the flat annular rim of the outer container. Energy directors may be formed on or in either or both flat surfaces for ultrasonic welding and sealing. An upper part of the upper lip of the inner container further comprises a rounded outward projection at a top of the radially outset cylinder.

The flutes extend inward from the inside wall of the inner container. The flutes have at their upper ends arched and rounded circular segments. The flutes and the rounded circular segments project inward from the inside surface of the inner container. Vertical lines separate the flat flutes. The vertical lines are downward extensions of a cylindrical area on the inside wall of the inner container. The flutes have flat, concave or convex inside surfaces.

An insulated drinking glass has inner and outer containers with a sealed space there between and a fluid with the space. The inner container has vertical flutes on a lower part of the inner wall and has curved segmental areas atop the flutes. A truncated conical upwardly and outwardly sloping area is located at tops of the curved segmental areas. Lines extend downwardly between the flat flutes from the conical sloping area.

The flutes have flat, concave or convex inner surfaces and curved outer surfaces that together form lenticular forms within the drinking glass. The lenticular forms are separated by the lines at intersections of the lenticular forms. The flutes have distinct inner surfaces and curved outer surfaces that together form lenses. The lenses are separated by sharp lines. The lenses enlarge images of objects within the drinking glass and enlarge images of objects outside of the drinking glass and make the images appear to enlarge, reduce and disappear, reappear and reduce as the drinking glass is turned. The lenses are separated by sharp lines, and the lenses enlarge and distort images of objects within a space between the inner and outer containers on a far side from a viewer. Curved segmental lenses extend inward from the inside wall above the flat flutes.

A drinking glass has an inside wall and an outer wall. Flat, concave or convex flutes are on a lower part of the inside wall. Curved segmental areas atop the flat flutes extend towards a lip of the drinking glass. A truncated conical upwardly and outwardly sloping area extends from tops of the curved segmental areas. Sharp dividing lines extend downwardly from the conical sloping area between the flutes.

Curved segmental lenses are positioned above the flutes. The outer wall of the drinking glass is curved, and the flutes and curved outer wall form lenses in a repeating lenticular form around the drinking glass.

At the bottoms of the flutes an inside wall curves downward to the inside bottom wall. Lines extending downward between the flutes are continued downward and inward between the inward curving walls. The inside curving walls intersect with an inside bottom wall in lines providing an appearance of facets along edges of the bottom wall.

One or more lights, LEDs, power sources and switches are contained in a space between the inner and outer containers, especially between the bottom of the inner container and the base of the outer container.

These and further and other objects and features of the invention are apparent in the disclosure, which includes the above and ongoing written specification, with the claims and the drawings.

BRIEF DESCRIPTION OF THE DRAWINGS

FIG. 1 is a cross sectional side elevation of the new thermal drinking glass taken along line 1-1 of FIG. 2.

FIG. 2 is a top view of the new drinking glass shown in FIG. 1.

FIG. 3 is a cross sectional side elevation of the outer sleeve or container taken along line 3-3 of FIG. 4.

FIG. 4 is a bottom view of the new thermal drinking glass shown in FIGS. 1-3.

DETAILED DESCRIPTION OF THE DRAWINGS

Figures 5, 6, 7, 8:
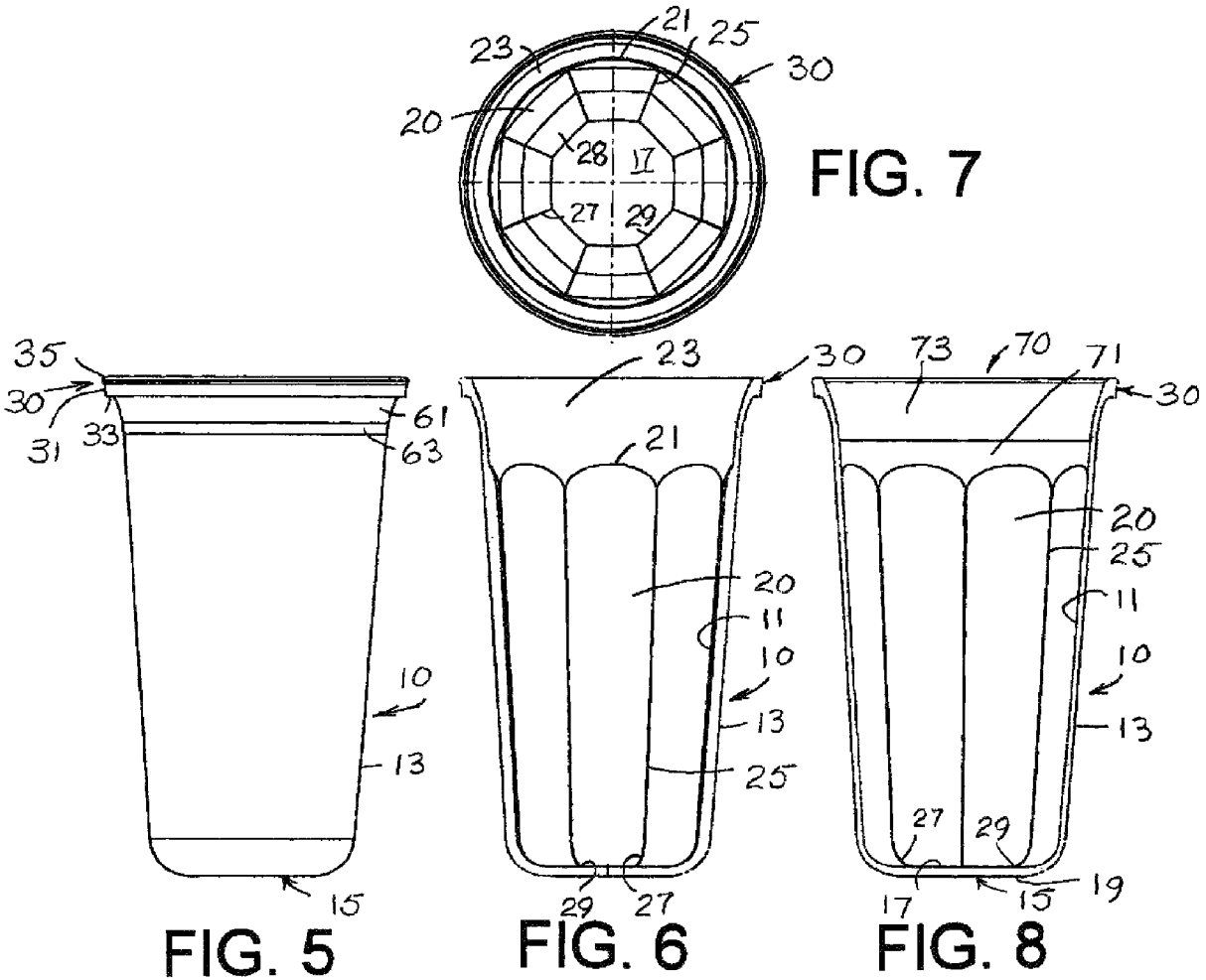
FIG. 5 is an elevation of the inner sleeve or container.
FIG. 6 is a cross section view of the inner sleeve or container taken along line 6-6 of FIG. 7.
FIG. 7 is a top view of the inner sleeve or container.
FIG. 8 is a cross section of the inner sleeve or container in an alternate embodiment.

A drinking glass first shown in FIG. 1 and drinking glass 1 has an inside container 10 and an outside container 40 surrounding and spaced 42 from the inside container. The outside container has an upper rim 53 contacting and sealed to an upper lip 30 of the inside container 10. A fluid is sealed in a space 42 between the inside container 10 and the outside container 40. The inside container 10 has an inside wall 11 and an outer wall 13. The outer container 40 has an inner wall 41 and an outside wall 43. The inside wall 11 of the inside container 10 has a series of generally vertically extending flutes 20 adapted for precisely locating the inside container for accurately and precisely placing multicolor images on the outer wall 13 of the container.

The inner container 10 has inside 17 and outer 19 bottom 15 surfaces. The outer container 40 has inner 47 and outside 49 base surfaces 45. The outer bottom surface 19 of the inner container 10 is spaced from the inner base surface 47 of the outer container 40.

The fluid sealed in the space 42 between the outer 10 and inner 40 containers is a gas. Alternatively, the fluid sealed in the space 42 between the outer and inner containers is a liquid. The fluid alternatively is a mixture of gases or a combination of diverse liquids or liquids and gases. The upper rim 53 of the outer container 40 is flat and annular. The upper lip 30 of the inner container 10 has a cylinder 31 radially outset from the outer wall of the inner container 10. A lower surface 33 of the cylinder is sealed with the flat annular rim 53 of the outer container 40. An upper part of the upper lip 30 of the inner container further comprises a rounded outward projection 35 at a top of the radially outset cylinder 31.

The flutes 20 extend between side edges 27 and upward from slopes 28 at the bottom edges 29 of the inside wall 11 of the inner container 10. The flat flutes 20 have at their upper ends arched and rounded curved segmental areas 21. The curved segmental areas 21 project inward from the inside surface 11 of the inner container 10. Vertical lines 25 separate the flutes 20. The vertical lines are downward extensions of a cylindrical area 23 on the inside wall 11 of the inner container 10.

An insulated drinking glass 1 has inner 10 and outer 40 containers with a sealed space 42 there between and a fluid with the space. The inner container has vertical flutes 20 on a lower part of the inner wall 11 and has curved segmental areas 21 atop the flutes 20. A truncated conical upwardly and outwardly sloping area 23 extends from the tops of the curved segments 21. Lines 25 extend downwardly between the flat flutes 20 from the conical sloping area 23.

The flutes have flat inner surfaces and curved outer surfaces 13 that together form lenticular forms within the drinking glass 1. The lenticular forms are separated by the lines 25 at intersections of the lenticular form flutes 20. The flutes 20 have flat inner surfaces and curved outer surfaces 13 that together form lenses. The lenses are separated by the lines 25 and enlarge images of objects within the drinking glass and enlarge images of objects outside of the drinking glass enlarge, reduce and disappear. The lenses are separated by the lines which enlarge and distort images of objects within a space between the inner and outer containers. Curved segmental lenses extend inward from the inside wall above the flat flutes.

A new drinking glass 10 has an inside wall and an outer wall. Flutes 20 are on a lower part of the inside wall have curved segmental areas 21 atop the flat flutes. A truncated conical upwardly and outwardly sloping area 23 extends from tops of the curved segmental areas 21. Sharp dividing lines 25 extend downwardly between the flutes 20 from the conical sloping area 23.

Curved segmental areas 21 extend above the flutes 20. The outer wall 13 of the drinking glass 1 is curved, and the flat flutes 20 and curved outer wall 13 form lenses in a repeating lenticular form around the drinking glass 10.

FIGS. 3 and 4 show a locator tab 57 extending upward from a side of the inner wall 47 of base 45 of the outer sleeve 40. A ridge 59 is also shown in FIG. 3 extending downward from the base 45.

FIGS. 5-7 show elements of the inner container 10 which also can be used as a drinking glass.

FIG. 8 shows a variation 70 of the inner container with a short upward and slightly outward sloping wall closely spaced above the segmental areas 21 and an upward and more outward sloping wall 73 above wall portion 71.

While the invention has been described with reference to specific embodiments, modifications and variations of the invention may be constructed without departing from the scope of the invention, which is defined in the following claims.

I claim:

1. Apparatus comprising a drinking glass further comprising an inner container and an outer container surrounding and spaced from the inner container, the outer container having an upper rim contacting and sealed to an upper lip of the inner container, a fluid sealed in a space between the inside container and the outer container, the inner container having an inside wall and an outer wall, the outer container having an inner wall and an outside wall, the outer wall of the inner container being circular, and the inner wall of the inside container having a series of generally vertically extending flat flutes with flat inside surfaces adapted for precisely locating the inner container for accurately and precisely placing multicolor images on the outer wall of the inner container.

2. The apparatus of claim 1, wherein the inside container has inside and outer bottom surfaces and wherein the outer container has inner and outside base surfaces, and wherein the outer bottom surface of the inner container is spaced from the inner base surface of the outer container.

3. The apparatus of claim 1, wherein the fluid sealed in the space between the outer and inner containers is a gas.

4. The apparatus of claim 1, wherein the fluid sealed in the space between the outer and inner containers is a liquid.

5. The apparatus of claim 1, wherein the upper rim of the outer container is flat and annular, the upper lip of the inner container further comprises a cylinder radially outset from the outer wall of the inner container, and wherein a lower surface of the cylinder is sealed with the flat annular rim of the outer container.

6. The apparatus of claim 5, wherein an upper part of the upper lip of the inner container further comprises a rounded outward projection at a top of the radially outset cylinder.

7. The apparatus of claim 1, wherein the flat inside surfaces of the flutes are longer than wide.

8. The apparatus of claim 7, further comprising vertical lines separating the flutes, and wherein the vertical lines are downward extensions of a curved segmental area on the inside wall of the inner container above the flat surfaces of the flutes.

9. The apparatus of claim 7, wherein the flutes have at their upper ends arched and rounded curved segmental areas.

10. The apparatus of claim 9, wherein the arched and rounded curved segmental areas form part of the inside surface of the inner container.

11. Apparatus comprising an insulated drinking glass having inner and outer containers with a sealed space therebetween and a fluid within the space, the inner container having vertical flat flutes on a lower part of an inside wall and having upwardly arched and curved segmental areas atop the flutes, a truncated conical outwardly and upwardly sloping area at tops of the curved segmental areas and lines extending downwardly between the flat flutes from the conical sloping area.

12. The apparatus of claim 11, wherein the flutes have flat inside surfaces and curved outer surfaces that together make lenticular forms around the drinking glass.

13. The apparatus of claim 12, wherein the lenticular forms are separated by lines at intersections of the lenticular forms.

14. The apparatus of claim 11, wherein the flutes have flat inside surfaces and curved outer surfaces that together form lenses.

15. The apparatus of claim 14, wherein the lenses are separated by sharp lines, and the lenses enlarge images of objects within the drinking glass.

16. The apparatus of claim 14, wherein the lenses are separated by lines, and the lenses enlarge images of objects outside of the drinking glass and make the images viewed through the drinking glass appear to enlarge, reduce and disappear as the drinking glass is turned.

17. The apparatus of claim 14, wherein the lenses are separated by sharp lines, and the lenses enlarge images of objects within a space between the inner and outer containers as viewed through the drinking glass.

18. The apparatus of claim 11, wherein the curved segmental areas form curved segmental lenses forming part of the inside wall of the inner container above the flat flutes.

19. The apparatus of claim 11, further comprising one or more lights, a power source and a switch inside a space between a bottom of the inner container and a base of the outer container.

20. The apparatus of claim 11, further comprising emblems on an outer wall of the inner container aligned with the flutes on the inside wall of the inner container.

21. The apparatus of claim 20, further comprising plastic or paper sheets, and solid materials in a space between the outer and inner containers.

* * * * *